United States Patent [19]

Bruce

[11] Patent Number: 4,701,863

[45] Date of Patent: Oct. 20, 1987

[54] APPARATUS FOR DISTORTION FREE CLEARING OF A DISPLAY DURING A SINGLE FRAME TIME

[75] Inventor: Kenneth E. Bruce, Nashua, N.H.

[73] Assignee: Honeywell Information Systems Inc., Waltham, Mass.

[21] Appl. No.: 681,537

[22] Filed: Dec. 14, 1984

[51] Int. Cl.[4] ..... G06F 15/62; G09G 1/16

[52] U.S. Cl. ..... 364/518; 364/521; 340/747; 340/750; 340/799; 340/814

[58] Field of Search ..... 364/518, 521; 340/747, 340/749, 750, 798, 799, 800, 801, 814, 703; 358/903

[56] References Cited

U.S. PATENT DOCUMENTS

| | | | |
|---|---|---|---|
| 4,016,544 | 4/1977 | Morita et al. | 340/703 X |
| 4,143,360 | 3/1979 | Bernhart et al. | 364/518 X |
| 4,270,125 | 5/1981 | Weisbecker | 340/798 X |
| 4,342,029 | 7/1982 | Hofmanis et al. | 340/703 |

*Primary Examiner*—Arthur T. Grimley
*Assistant Examiner*—J. Pendegrass
*Attorney, Agent, or Firm*—George Grayson; John S. Solakian

[57] ABSTRACT

A graphics display is cleared by apparatus forcing binary ZERO's into all locations of the bit map memories between successive vertical synchronization operations during a write refresh operation.

6 Claims, 3 Drawing Figures

APPARATUS FOR DISTORTION FREE CLEARING OF A DISPLAY DURING A SINGLE FRAME TIME

RELATED APPLICATIONS

The following U.S. patent applications, one of which is filed on an even date with the instant application, are assigned to the same assignee as the instant application, are related to the instant application and are incorporated herein by reference.

1. "Automatic Pattern Generation for a Graphics Display" by Kenneth E. Bruce, Thomas O. Holtey and Gary J. Goss, having U.S. Ser. No. 637,680 and filed on Aug. 6, 1984.

2. "Multiple Color Generation on a Display" by Thomas O. Holtey, Kenneth E. Bruce and Gary J. Goss, having U.S. Ser. No. 681,539 and filed on Dec. 14, 1984.

BACKGROUND OF THE INVENTION

1. Field of the Invention

This invention relates generally to a graphics display in a data processing system, and more particularly to apparatus for clearing the display between successive vertical synchronization operations.

2. Description of the Prior Art

Graphics and alphanumeric text are displayed visually in many business applications. This allows the relationship between many variables of the business to be presented in pie chart or bar graph form. The graphics may also be used to display and manipulate mechanical or electronic designs.

An operator may want to view several charts in rapid succession requiring bit map memories to be cleared of the old information, after which new information is written into the bit map memories. The bit map memories, one for each primary color, store an image of the screen in typically a solid state memory.

The prior art uses a software technique for clearing each bit map memory. Since the software is not timed to the horizontal and vertical synchronization operations of the display, the image on the screen is distorted during the software clear operation. This distortion is annoying to an operator, particularly when the display is used for long periods of time. To avoid this condition, the software must first turn off the display, then clear and then turn the display back on. This same procedure may also be accomplished in hardware with cyclic operations within the hardware.

OBJECTS OF THE INVENTION

It is a primary object of the invention to have an improved display system.

It is an object of the invention to have an improved graphics display system.

It is another object of the invention to have an improved graphics system which uses improved apparatus for clearing the display without distortion.

SUMMARY OF THE INVENTION

The graphics display system includes a color display with bit map memories, one for each basic color, which store an image of their respective color being displayed. The display is cleared by writing binary ZERO in each addressed location in each bit map memory.

The display is made up of 720 pixels on each scan line. There are 300 scan lines in the displayed area, making a total of 216,000 pixels. Each bit map memory, therefore, stores 216,000 bits of information for display.

The display is refreshed 60 times per second, that is, each location in bit map memory is read sequentially between successive vertical synchronization signals.

As the beam moves horizontally across the face of the display, bits are read from the bit map memories and written as pixels along each horizontal scan line. After the 300th horizontal scanline is displayed, that is, the bottom scan line, the beam is deflected to the top horizontal scan line during the vertical synchronization operation.

A clear flip-flop 8-8 is set by signals generated by the software during a bit map memory write operation.

A vertical synchronization flip-flop 8-16 is set when the RAS/CAS counter 4 indicates that the 300th horizontal scan line is being displayed and the display enable signal DSPEN7-00 terminates. Flip-flop 8-16 and signal DSPEN8-00 indicate the end of the 300th horizontal scan line. A vertical synchronization signal is generated.

A clear cycle flip-flop 8-10 is set by the vertical synchronization signal at the end of the 300th scan line and remains set for the 300 horizontal scan lines, that is, until the next vertical synchronization signal.

The clear cycle signal from flip-flop 8-10 disables the data input AND gates forcing the data input signals to the bit map memory to binary ZERO. Since the AND gates are disabled for the time it takes for the display to sweep the 300 horizontal scan lines, binary ZERO is written into all locations of the bit map memories used for display.

BRIEF DESCRIPTION OF THE DRAWINGS

The novel features which are characteristic of the invention are set forth with particularity in the appended claims. The invention itself, however, both as to organization and operation may best be understood by reference to the following description in conjunction with the drawings in which:

DESCRIPTION OF THE PREFERRED EMBODIMENT

Figure 1:
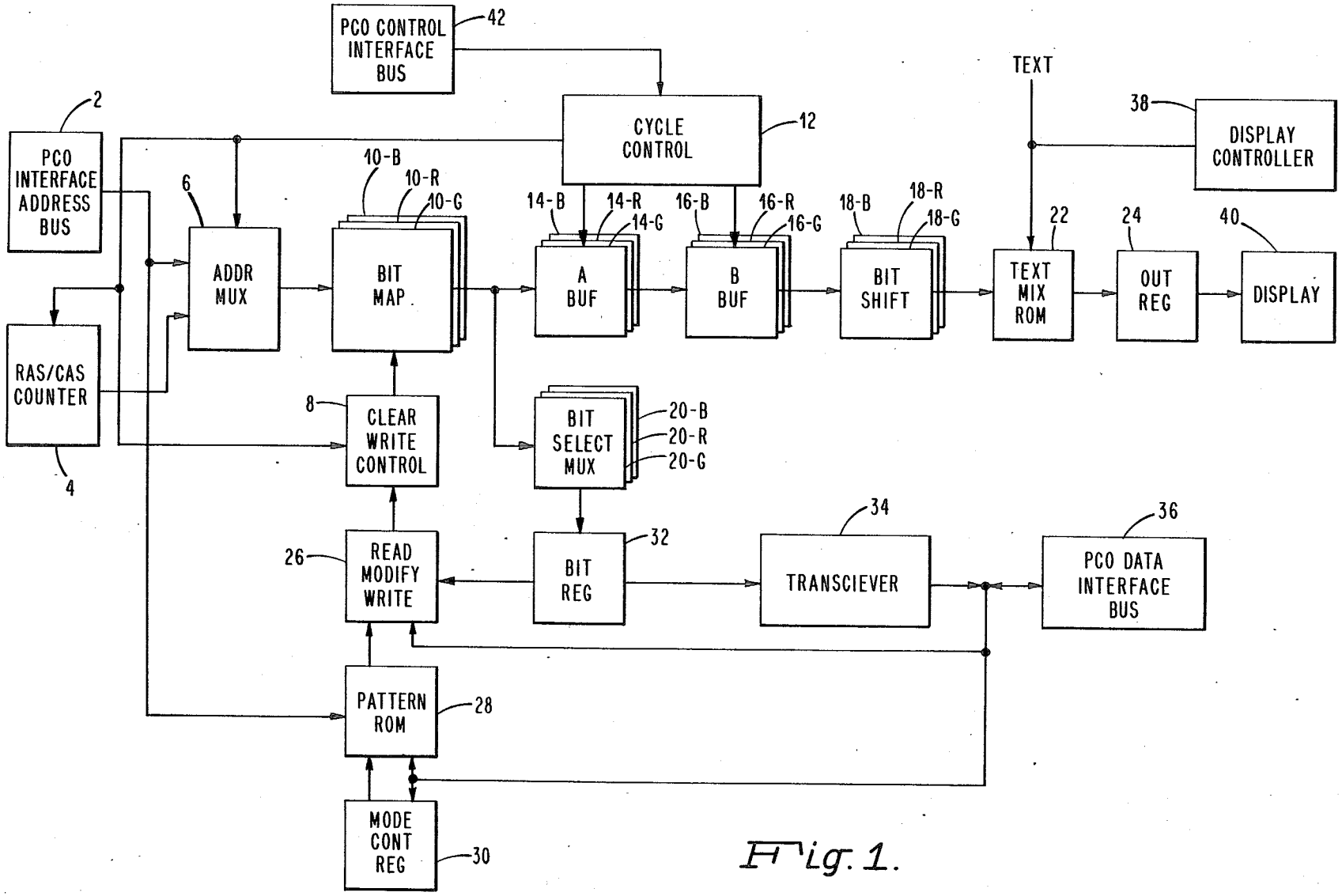
FIG. 1 shows an overall block diagram of the graphics system.

FIG. 1 shows an overall block diagram of a display subsystem for displaying graphics in color on a display 40, typically a cathode ray tube (CRT) display.

Address information is received by the graphics display subsystem from a personal computer option (PCO) interface address bus 2. Data information is received from a PCO interface data bus 36 and control information is received from a PCO interface control bus 42. The PCO interface may receive information from a typical personal computer (not shown) or any typical data processing system (not shown).

The graphics display is aimed at the business graphics marketplace wherein the ability to generate and modify color pie charts, line charts and the like is a requirement.

Bit map memory 10-G stores bits which represent a green image on the display 40, bit map memory 10-R stores bits which represent a red image on the display 40 and bit map memory 10-B stores bits which represent a blue image on the display 40.

The bit map memories 10-G, 10-R and 10-B are addressed via an address multiplexer (MUX) 6 from either the PCO interface address bus 2 or the row and column address (RAS/CAS) counter 4. The address signals from the PCO interface address bus 2 may be used to update portions of the display with data received from the PCO interface data bus 36. The address signals from the RAS/CAS counter 4 may be used to sequentially read out the bits from the bit map memories 10-G, 10-R and 10-B for display on display 40. Note that eight possible colors are possible by using combinations of the same address location in each of the bit map memories 10-G, 10-R and 10-B for displaying a pixel.

A cycle control 12 which receives control signals from PCO interface control bus 42 controls the operation of the address MUX 6 and the RAS/CAS counter 4 to read bytes from bit map memories 10-G, 10-R and 10-B; A buffers 14-G, 14-R and 14-B; B buffers 16-G, 16-R and 16-B; and shift registers 18-G, 18-R and 18-B, respectively. A bit from each bit map memory 10-G, 10-R and 10-B representative of a pixel addresses a text mix read only memory (ROM) 22. The output signals of ROM 22 are applied to an output register 24 for transfer to display 40 for displaying the color pixel.

Address signals from PCO interface address bus 2 are also applied to a pattern ROM 28 which provides signals to bit map memories 10-G, 10-R and 10-B to provide shades of the eight basic colors for the display in defined areas. A mode and output register 30 provides signals to define the mode of operation, either a REPLACE mode, an OR mode or an EXCLUSIVE OR mode. This is described in copending related application Ser. No. 681,539 entitled "Multiple Color Generation on a Display".

Bit select multiplexers (MUX) 20-G, 20-R and 20-B each select a bit from the byte read from the bit map memories 10-G, 10-R and 10-B, respectively, for storage in a bit register 32. The bit register output signals are applied to a read modify write 26. The read modify write 26 also receives the data bits from the pattern ROM 26 and performs the specified operation as indicated by the contents of mode control register 30 and writes the output of read modify write 26 into the bit map memories 10-G, 10-R and 10-B via a clear write control 8.

Clear write control 8 will transfer the output bit from read modify write 26 or will write ZERO bits into bit map memories 10-G, 10-R and 10-B if the clear operation is specified by signals derived from firmware or software and received over PCO interface control bus 42 and PCO interface data bus 36. The text mix ROM 22 may combine text received from the display controller 38 with the graphics.

Figure 2:
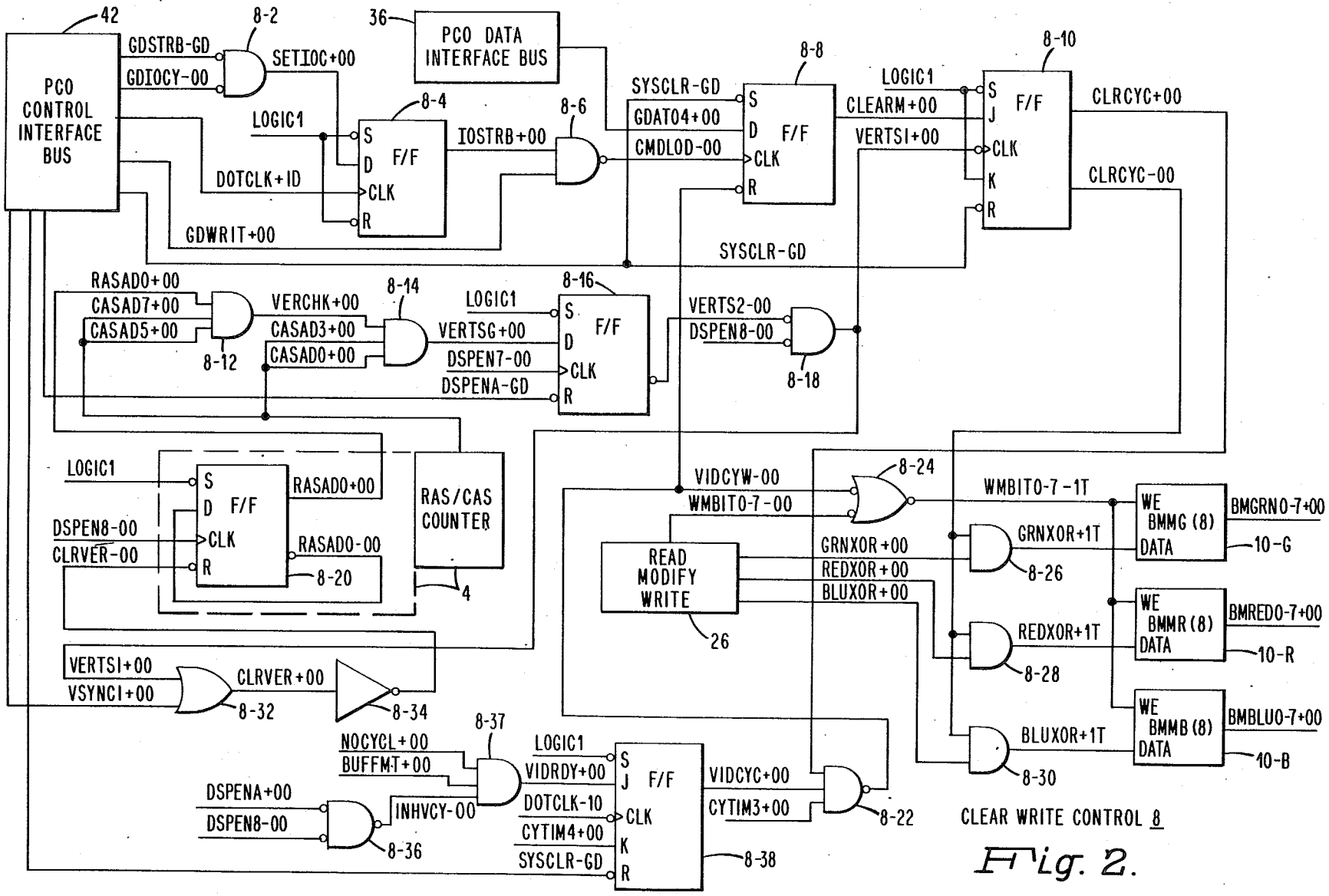
FIG. 2 shows a detailed logic diagram of the clear write control.

FIG. 2 shows the detailed logic for clearing the bit map memories 10-G, 10-R and 10-B between successive vertical synchronization retrace operations. Information is displayed on the screen during the 300 scan lines (horizontal raster sweeps). The beam is returned from the end of the bottom horizontal scan line to the beginning of the top horizontal scan line by the vertical retrace operation. The bit map memories 10-G, 10-R and 10-B are cleared when requested during the time between successive vertical retrace operations as represented by the vertical sync signal VERTS1+00 setting a flip-flop 8-10 on the first vertical sync cycle and resetting the flip-flop 8-10 on the next vertical sync cycle.

During normal display operation, the strobe signal GDSTRB−GD and the input/output (I/O) cycle signal GDIOCY−00 from PCO interface control bus 42 are applied to a negative AND gate 8-2 to generate a set I/O cycle signal SETIOC+00. This sets a flip-flop 8-4 on the rise of the DOTCLK+1D clocking signal. The output signal IOSTRB+00 and the display write signal GDWRIT+00 are applied to a NAND gate 8-6. An output signal CMDLOD−00 initiates the writing of control storage flip-flop 8-8. Signals GDSTRB−GD, GDIOCY−00, GDWRIT+00 and DOTCLK+1D are received from the PCO interface control bus 42. The DOTCLK+1D signal times the graphics logic to the loading of control information and to the reading and writing of the pixels representing the graphics pattern on the face of the display 40.

However, if the entire display is to be blanked, data signal GDAT04+00 is received from the PCO interface data bus 36 to set a control storage flip-flop 8-8 on the rise of the CMDLOD−00 signal. The flip-flop 8-8 clear memory signal CLEARM+00 is applied to the J terminal of flip-flop 8-10 which sets on the first occurrence of the fall of the vertical sync signal VERTS1+00 to generate the clear cycle signals CLRCYC+00 high and CLRCYC−00 low.

The vertical sync signal VERTS1+00 is generated in a logic sequence which is initiated at the end of the 299th horizontal scan line cycle by the rise of a display enable signal DSPEN8−00 setting flip-flop 8-20 since signal RASAD0−00 applied to the D input terminal is high. Signal RASAD0−00 will toggle at the end of each horizontal scan line. Output signal RASAD0+00 is applied to an AND gate 8-12 which generates the VERCHK+00 signal when the column address signals CASAD5+00 and CASAD7+00 are high. Signal VERCHK+00 is applied to an AND gate 8-14 to generate signal VERTSG+00 when column address signals CASAD3+00 and CASAD0+00 are high. Signals CASAD0+00, CASAD3+00, CASAD5+00, CASAD7+00 and RASAD0+00 (binary 100101011 indicates decimal 299 or the 300th horizontal scan line (0–299)) from RAS/CAS counter 4.

Signal VERTSG+00 is applied to the D terminal of a flip-flop 8-16 which sets on the rise of the DSPEN7−00 signal to force the VERTS2−00 signal low. Signals DSPEN8−00 and VERTS2−00 low applied to a negative AND gate 8-18 generate the VERTS1+0 signal which starts the vertical synchronization operation.

Signals CASAD0+00, CASAD3+00, CASAD5+00, CASAD7+00 and RASAD0+00 high and signal DSPEN8−00 low signal the end of the 300th horizontal scan line which is scan line 299.

Flip-flop 8-20 is reset at the end of the 300th scan line when signal VERTS1+00 goes high. This generates a clear signal CLRVER+00 which is inverted by an inverter 8-34 to force signal CLRVER−00 low thereby resetting flop 8-20.

The video cycle write signal VIDCYW−00 will reset flip-flop 8-8 during the clear cycle. This results in flip-flop 8-10 resetting at the second occurrence of the fall of the VERTS1+00 signal. At this time the bip map memories 10-G, 10-R and 10-B are cleared and the display 40 is blanked.

The VIDCYW−00 signal is generated at the end of the 300th horizontal scan line after display enable signals DSPENA+00 and DSPEN8−00 applied to a negative AND gate 8-36 are low forcing signal INHVCY−00 low. Signal INHVCY−00 goes high when signal DSPEN8−00 goes high allowing an AND gate 8-37 signal VIDRDY+00 to go high causing a flip-flop 8-38 to set on the fall of a DOTCLK−10 clock signal. This forces signal VIDCYC+00 high. Since signals CLRCYC+00, VIDCYC+00 and CYTIM3+00 applied to a NAND gate 8-22 are high, output signal VIDCYW−00 is low resetting flip-flop 8-8 and write enabling bit map memories 10-G, 10-R and 10-B via eight negative OR gates 8-24 by generating eight signals WMBIT0−1T through WMBIT7−1T.

AND gate 8-37 signal VIDRDY+00 is enabled when A buffers 14-G, 14-R and 14-B are empty as indicated by signal BUFFMT+00 and no other activity is currently taking place as indicated by signal NOCYCL+00.

Each color bit map memory is made up of eight 2674-3 memory chips described in the "Motorola Memory Data Manual, MCM 6664A" published 1982 by Motorola Semiconductor Products, 3801 Ed Bluestein Blvd., Austin, Tex. 78721. Each memory chip when addressed supplies one pixel of the display.

Signals WMBIT0−00 through WMBIT7−00 are each received from the respective negative OR gate 8-24 to generate the bit map memory write enable signal during normal display operation. During the clear operation, signals BMGRN0+00 through BMGRN7+00, BMRED0+00 through BMRED7+00, and BMBLU0+00 through BMBLU7+00 will be written to a logical ZERO.

Signal CLRCYC−00 applied to AND gates 8-26, 8-28 and 8-30 will force the output signals GRNXOR+IT, REDXOR+IT and BLUXOR+IT to logical ZERO and then they are applied to the data input terminals of their repsective bit map memories 10-G, 10-R and 10-B. Signals GRNXOR+00, REDXOR+00 and BLUXOR+00 from read modify write 26 provide input signals to the respective bit map memories 10-G, 10-R and 10-B during the normal write operation.

The above description applies until the 300th horizontal scan line is cleared then, since flip-flop 8-8 was reset, the CLEARM+00 signal is low; flip-flop 8-10 is reset by the VERTS1+00 signal. This forces signal CLRCYC−00 high enabling AND gates 8-26, 8-28 and 8-30. Also signal CLRCYC+00 is low disabling NAND gate 8-22. Since signal VIDCYW−00 is high, the eight negative OR gates are conditioned to accept the eight write enable signals WMBIT0−00 through WMBIT7−00.

Figure 3:
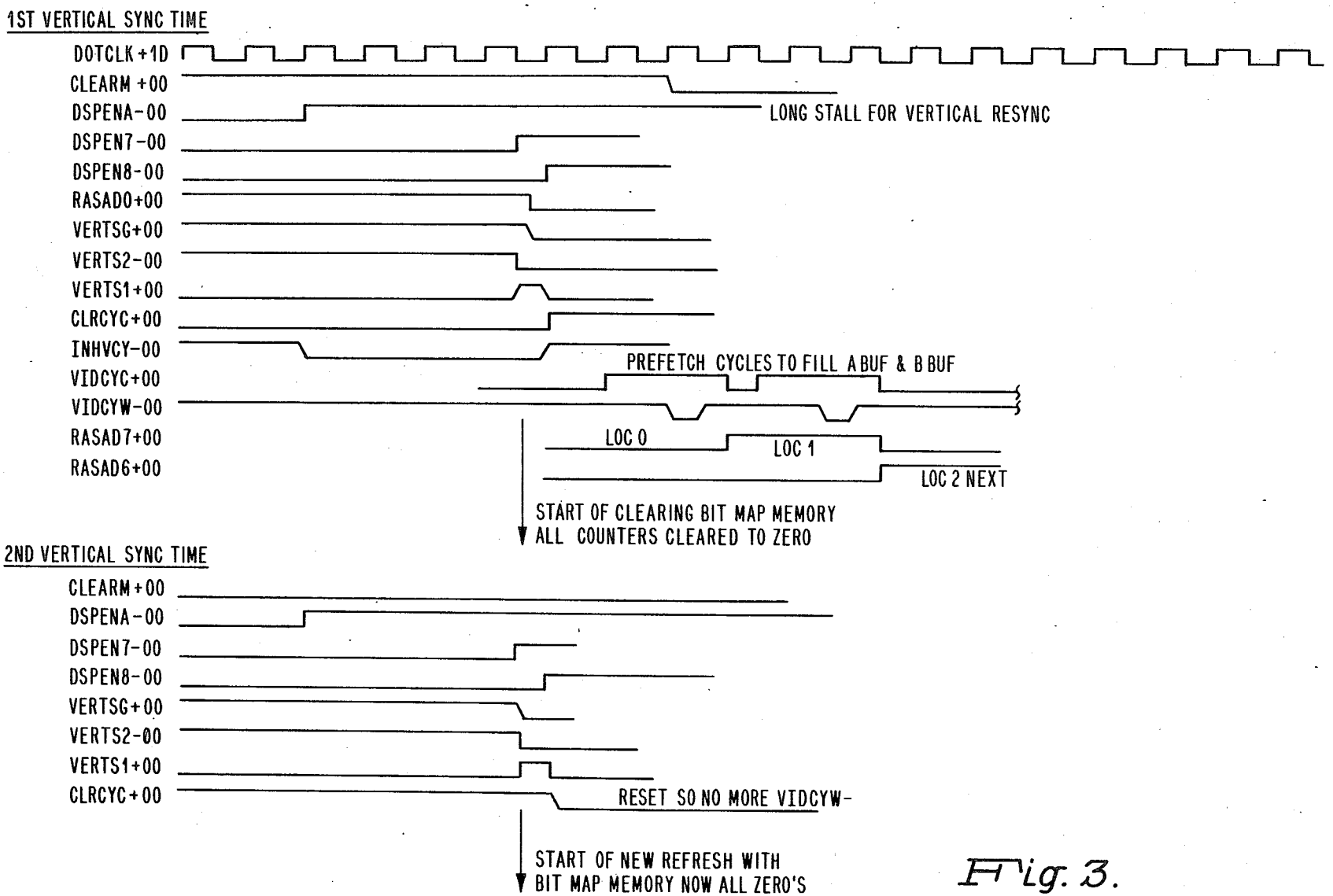
FIG. 3 shows a timing diagram of the clear write control operation.

FIG. 3 shows the timing diagram leading up to the bit map memory clear operation during the 300th horizontal scan line of the previous graphics display, which generates the first vertical sync signal VERTS1+00, then the 300th horizontal scan line of the clear memory operation generates the second vertical sync signal VERTS1+00.

The display beam is returned to the start of the first horizontal scan line during a vertical retrace operation. A clear bit map memory write operation is initiated by signal CLEARM+00 going high which conditions signal CLRCYC+00 high. This results in a write bit map memory operation; however, the inputs to the bit map memories 10-G, 10-R and 10-B are kept at binary ZERO. This forces all locations to binary ZERO. The clear operation is concluded at the end of this display cycle when the next vertical retrace operation is initiated.

The logic is timed to the display by the DOTCLK+1D clock which indicates successive pixel positions.

Signal CLEARM+00 is forced high by the software to indicate a clear operation during the next complete display cycle, horizontal scan lines 000 through 299. Signal DSPENA−00 is low for each horizontal scan line, going high at the end of each horizontal scan line. Signal DSPENA+00 is the inverse.

Signal DSPEN7−00 follows signal DSPENA−00 by seven DOTCLK+1D cycles and signal DSPEN8−00 follows signal DSPEN7−00 by one DOTCLK+1D cycle. Signals DSPEN7−00 and DSPEN8−00 control the relative timing of the clear operation logic.

Signal RASAD0+00 when high indicates an odd numbered horizontal scan line (1, 3 . . . 297, 299).

Signal VERTSG+00 is high during the 299th horizontal scan line and then goes low at the end of the 299th horizontal scan line when signal RASAD0+00 goes low. Signals CASAD0+00, CASAD3+00, CASAD5+00, CASAD7+00 and RASAD0+00 indicate binary 100101011.

Signal VERTS2−00 times the clear logic to the display enable signals by going low on the rise of signal DSPEN7−00.

Signal VERTS1+00 is therefore high for the one DOTCLK+1D cycle when signal DSPEN7−00 is high and signal DSPEN8−00 is low.

Signal CLRCYC+00 goes high on the fall of signal VERTS1+00.

Signal INHVCY−00 inhibits signal VIDCYC+00 at the end of each horizontal scan line to synchronize the addressing of bit map memory read cycles to the RAS/CAS address counter.

Signal VIDCYC+00 controls the ABUF 14-G, 14-R and 14-B and BBUF 16-G, 16-R and 16-B load timing. Although to binary ONE bits are written into the bit map memories 10-G, 10-R and 10-B, the ABUF and BBUF logic are conditioned for normal cycle timing thereby using the same logic as in the normal display operation.

Signal VIDCYW−00 is timed to the CYTIM3+00 timing signal to condition the write enable logic of the bit map memories 10-G, 10-R and 10-B.

The RAS/CAS counters 4 are initially cleared to ZERO and then are incremented by signal VIDCYC+00 and DSPEN8−00 to address each location of the bit map memories 10-G, 10-R and 10-B in turn to force binary ZERO's, a byte at a time, into the bit map memories when signal CLRCYC−00 is low.

At the end of the clear cycle as indicated by the next vertical retrace cycle, signal CLEARM+00 is now low because signal VIDCYW−00 went low to reset flop 8-8.

Signals DSPENA−00, DSPEN7−00, DSPEN8−00, VERTSG+00, VERTS2−00 and VERTS1+00 are timed as described above since this is again the end of the 300th horizontal scan line. However, signal CLRCYC+00 is low since signal CLEARM+00 is now low.

Normal operation now follows with a blank display since the bit map memories 10-G, 10-R and 10-B which contain all ZERO's are now ready to be loaded with a new graphics display.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A color graphics display system includes a color display, a plurality of bit map memories for storing bits representative of an image displayed on said color display, and a clearing apparatus for clearing said image, said clearing apparatus comprising:

bus means for receiving a data signal and a plurality of control signals for indicating a clear operation;

counting means coupled to said bus means and responsive to a first control signal for counting the number of horizontal scan lines forming said image and generating a first occurrence of a vertical synchronization signal when said counting means indicates a predetermined count corresponding to the end of a raster scan;

clear cycle means coupled to said bus means and said counting means and responsive to the vertical synchronization signal and a second control signal to generate a clear cycle signal in a first state indicating the start of a clear image cycle;

memory addressing means coupled to said counting means and responsive to a sequence of count signals generated by said counting means for generating a sequence of address signals for addressing the bit map memories during a display cycle for reading the bits representative of an image displayed to the color display; and write memory means coupled to said clear cycle means and said memory addressing means and responsive to said clear cycle signal and said sequence of address signals for writing binary ZERO bits in each location of said plurality of bit map memories specified by said sequence of address signals during a display cycle;

said clear cycle means being responsive to a second occurrence of said vertical synchronization signal for generating said clear cycle signal in a second state thereby indicating the end of said clear image cycle at the end of a display cycle.

2. The apparatus of claim 1 wherein said counting means comprises:

counter means for generating said sequence of count signals;

first flip-flop means for generating a scan line signal of the duration of alternate horizontal scan lines; and gate means coupled to said counter means and said flip-flop means and responsive to selected count signals and said scan line signal for generating each occurrence of said vertical synchronization signal, said selected count signals and said scan line signal being representative of said predetermined count.

3. The apparatus of claim 2 wherein said predetermined count is 299 and indicates the last horizontal scan line of said image.

4. The apparatus of claim 1 wherein said clear cycle means comprises:

first means responsive to said second control signal, said control signal comprising, a load signal, an input/output cycle signal, a strobe signal, and a write operation signal for said plurality of bit map memories.

5. The apparatus of claim 4 wherein said clear cycle means further comprises:

second flip-flop means coupled to said first means and responsive to said load signal and said data signal for generating a clear memory signal.

6. The apparatus of claim 5 wherein said clear cycle means further comprises:

third flip-flop means coupled to said second flip-flop means and said gate means and responsive to said first occurrence of said vertical synchronization signal for generating said clear cycle signal, said third flip-flop means being responsive to said second occurrence of said vertical synchronization signal for generating said clear cycle signal.

* * * * *